US010236615B2

(12) United States Patent
Yamakami et al.

(10) Patent No.: US 10,236,615 B2
(45) Date of Patent: Mar. 19, 2019

(54) CONNECTOR WITH UPPER INSULATING BODY AND LOWER INSULATING BODY

(71) Applicant: FUJITSU COMPONENT LIMITED, Tokyo (JP)

(72) Inventors: Tohru Yamakami, Tokyo (JP); Koki Sato, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/884,787

(22) Filed: Jan. 31, 2018

(65) Prior Publication Data

US 2018/0241144 A1 Aug. 23, 2018

(30) Foreign Application Priority Data

Feb. 17, 2017 (JP) ..... 2017-027666

(51) Int. Cl.

| | |
|---|---|
| ***H01R 24/00*** | (2011.01) |
| ***H01R 13/26*** | (2006.01) |
| ***H01R 12/71*** | (2011.01) |
| ***H01R 13/502*** | (2006.01) |
| ***H01R 13/6477*** | (2011.01) |
| ***H01R 13/40*** | (2006.01) |
| ***H01R 24/60*** | (2011.01) |
| *H01R 13/41* | (2006.01) |
| *H01R 13/645* | (2006.01) |
| *H01R 107/00* | (2006.01) |

(52) U.S. Cl.

CPC ..... *H01R 13/26* (2013.01); *H01R 12/716* (2013.01); *H01R 13/40* (2013.01); *H01R 13/502* (2013.01); *H01R 13/6477* (2013.01); *H01R 24/60* (2013.01); *H01R 13/41* (2013.01); *H01R 13/6456* (2013.01); *H01R 2107/00* (2013.01)

(58) Field of Classification Search

CPC ..... H01R 12/724; H01R 13/26; H01R 13/40; H01R 13/502; H01R 24/60; H01R 24/62; H01R 24/64; H01R 12/716; H01R 13/6477

USPC ..... 439/676, 941, 78, 884, 79

See application file for complete search history.

(56) References Cited

U.S. PATENT DOCUMENTS

| | | | | |
|---|---|---|---|---|
| 6,623,308 | B2 | 9/2003 | Ono | |
| 9,705,219 | B2 * | 7/2017 | Yamakami | H01R 12/724 |
| 9,711,880 | B2 * | 7/2017 | Kiryu | H01R 12/716 |

(Continued)

FOREIGN PATENT DOCUMENTS

| | | |
|---|---|---|
| JP | 2002-008753 | 1/2002 |
| JP | 2011-003286 | 1/2011 |

(Continued)

*Primary Examiner* — Chandrika Prasad
(74) *Attorney, Agent, or Firm* — IPUSA, PLLC

(57) ABSTRACT

A connector includes a plurality of contacts, each including an upper linear portion, a side linear portion and a bent portion between the upper linear portion and the side linear portion; an upper insulating body; and a lower insulating body, the contacts being provided such that a side surface of the lower insulating body faces the side linear portion of each of the contacts, and an upper surface of the lower insulating body faces the upper linear portion of each of the contacts, upper protrusions being provided at the upper surface of the lower insulating body such that each of the upper protrusions positions between the upper linear portions of the adjacent contacts.

4 Claims, 7 Drawing Sheets

(56) References Cited

U.S. PATENT DOCUMENTS

| | | | | |
|---|---|---|---|---|
| 2012/0231666 | A1* | 9/2012 | Takahashi | H01R 12/721 439/626 |
| 2013/0065460 | A1* | 3/2013 | Hirata | H01R 12/716 439/884 |
| 2013/0109245 | A1* | 5/2013 | Tseng | H01R 12/62 439/682 |
| 2015/0031241 | A1 | 1/2015 | Yang | |
| 2015/0044914 | A1 | 2/2015 | Kimura | |
| 2016/0126658 | A1* | 5/2016 | Yamakami | H01R 12/724 439/660 |

FOREIGN PATENT DOCUMENTS

| | | |
|---|---|---|
| JP | 2016-091598 | 5/2016 |
| WO | 2004/075361 | 9/2004 |
| WO | 2011/075733 | 6/2011 |

* cited by examiner

CONNECTOR WITH UPPER INSULATING BODY AND LOWER INSULATING BODY

CROSS-REFERENCE TO RELATED APPLICATION

The present application is based on and claims the benefit of priority of Japanese Priority Application No. 2017-027666 filed on Feb. 17, 2017, the entire contents of which are hereby incorporated by reference.

BACKGROUND OF THE INVENTION

1. Field of the Invention

The present invention relates to a connector.

2. Description of the Related Art

A connector is used as a component to connect electronic devices. By electrically connecting a connector that is electrically connected to one of the electronic devices with another connector that is electrically connected to the other of the electronic devices, an electric signal can be transmitted between the electronic devices.

PATENT DOCUMENTS

[Patent Document 1] Japanese Laid-open Patent Publication No. 2002-8753
[Patent Document 2] Japanese Laid-open Patent Publication No. 2011-3286
[Patent Document 3] Japanese Laid-open Patent Publication No. 2016-91598

SUMMARY OF THE INVENTION

A connector that can easily adjust impedance, and also that can transmit an electric signal at high speed as fast as possible is required.

According to an embodiment, there is provided a connector including a plurality of contacts, each including an upper linear portion, a side linear portion and a bent portion between the upper linear portion and the side linear portion; an upper insulating body; and a lower insulating body, the contacts being provided such that a side surface of the lower insulating body faces the side linear portion of each of the contacts, and an upper surface of the lower insulating body faces the upper linear portion of each of the contacts, upper protrusions being provided at the upper surface of the lower insulating body such that each of the upper protrusions positions between the upper linear portions of the adjacent contacts.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1A:
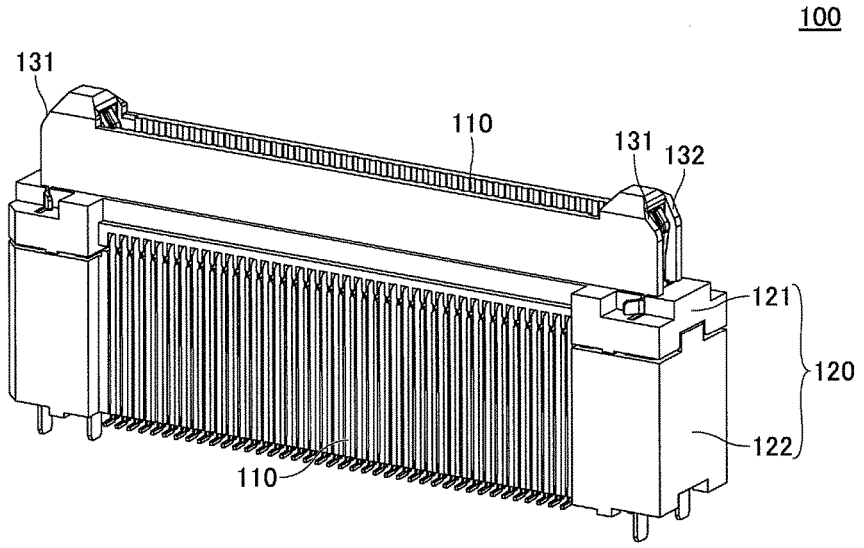
FIG. 1A and FIG. 1B are perspective views of connectors of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(Engagement of Connectors)

Figure 1B:
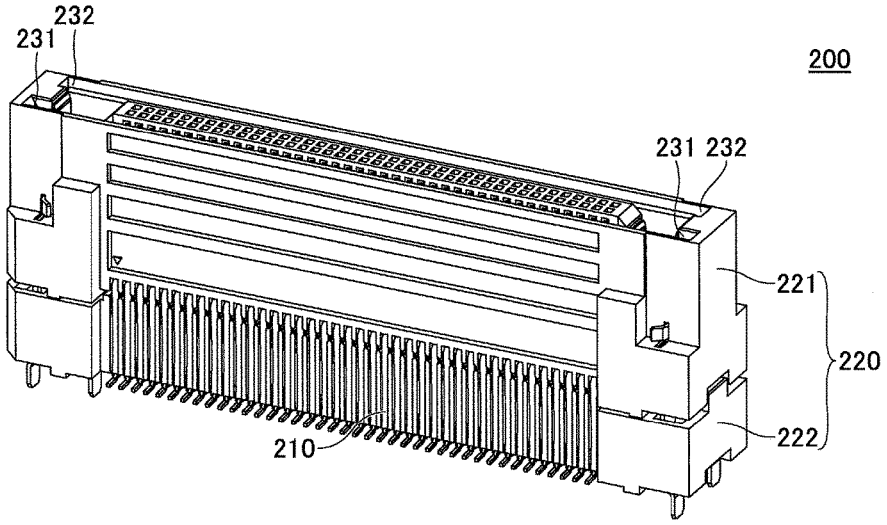
Figure 2A:
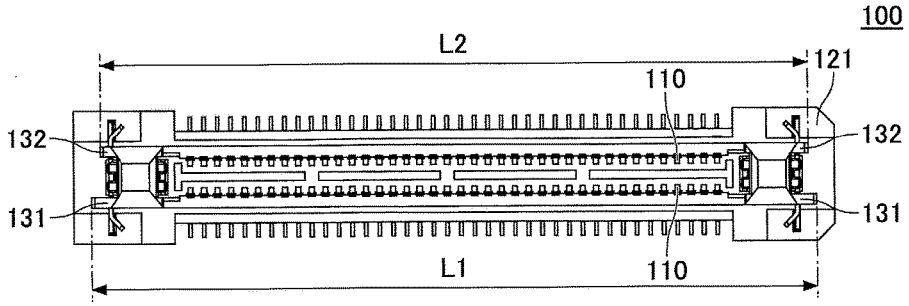
FIG. 2A and FIG. 2B are top views of the connectors of the embodiment.
Figure 2B:
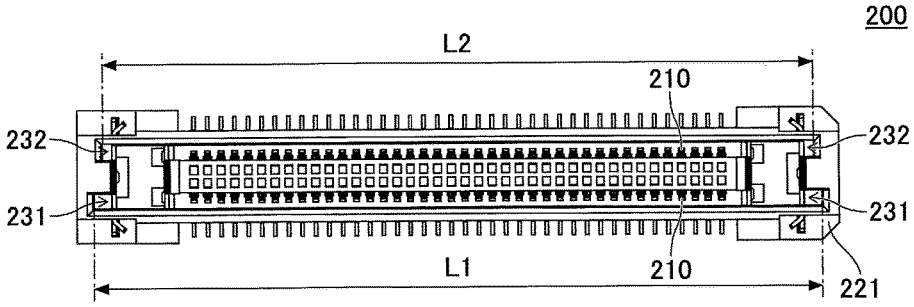

A connector of the embodiment is described with reference to FIG. 1A to FIG. 2B. FIG. 1A is a perspective view of a plug connector 100, and FIG. 1B is a perspective view of a jack connector 200, of the embodiment. FIG. 2A is a top view of the plug connector 100, and FIG. 2B is a top view of the jack connector 200, of the embodiment.

The plug connector 100 includes a plurality of plug contacts 110 placed at an insulating body portion 120. Similarly, the jack connector 200 includes a plurality of jack contacts 210 placed at an insulating body portion 220.

The insulating body portion 120 includes an upper insulating body 121 and a lower insulating body 122. Similarly, the insulating body portion 220 includes an upper insulating body 221 and a lower insulating body 222. Each of the upper insulating body 121, the lower insulating body 122, the upper insulating body 221 and the lower insulating body 222 is made of an insulating material such as liquid crystal polymer (LCP) resin.

In this embodiment, the plug contacts 110 and the jack contacts 210 each transmits an electric signal are made of a metal material.

In this embodiment, when the plug connector 100 and the jack connector 200 are engaged, the plug contacts 110 and the jack contacts 210 are contacted and electrically connected with each other, respectively, and electric signals can be transmitted.

In the plug connector 100, the plurality of plug contacts 110 are aligned in two lines that are facing with each other. Similarly, in the jack connector 200, corresponding to the plug contacts 110, the plurality of jack contacts 210 are aligned in two lines that are facing with each other.

First protruding portions 131 and second protruding portions 132 are provided near both ends of the upper insulating body 121 of the plug connector 100 in a longitudinal direction. The first protruding portions 131 are provided at both ends of one of the lines of the plug contacts 110, respectively. Similarly, the second protruding portions 132 are provided at both ends of the other of the lines of the plug contacts 110, respectively. As illustrated in FIG. 2A, a length "L1" from an end of one of the first protruding portions 131 to an end of the other of the first protruding portions 131 is longer than a length "L2" from an end of one of the second protruding portions 132 to an end of the other of the second protruding portions 132.

Further, first groove portions 231 in which the first protruding portions 131 are respectively input, and second groove portions 232 in which the second protruding portions 132 are respectively input are provided near both ends of the upper insulating body 221 of the jack connector 200. Thus, a length from an end of one of the first groove portions 231 to an end of the other of the first groove portions 231 is formed to be the same as "L1". Meanwhile, a length from an end of one of the second groove portions 232 to an end of the other of the second groove portions 232 is formed to be the same as "L2".

In this embodiment, the plug connector 100 and the jack connector 200 are engaged with each other, when the first protruding portions 131 and the second protruding portions 132 of the plug connector 100 are respectively inserted in the first groove portions 231 and the second groove portions 232 of the jack connector 200.

As described above, the length "L1" between the two first protruding portions 131 and the length "L2" between the two second protruding portions 132 are different. Similarly, the length "L1" between the two first groove portions 231 and the length "L2" between the two second groove portions 232 are different. Thus, even when the first protruding portions 131 of the plug connector 100 are tried to be inserted in the second groove portions 232 of the jack connector 200, as the length "L1" between the first protruding portions 131 is longer than the length "L2" between the second groove portions 232, the first protruding portions 131 cannot be inserted in the second groove portions 232, respectively. With this, the plug connector 100 and the jack connector 200 are prevented from being engaged in a wrong direction.

(Placement of Contacts)

Figure 3:
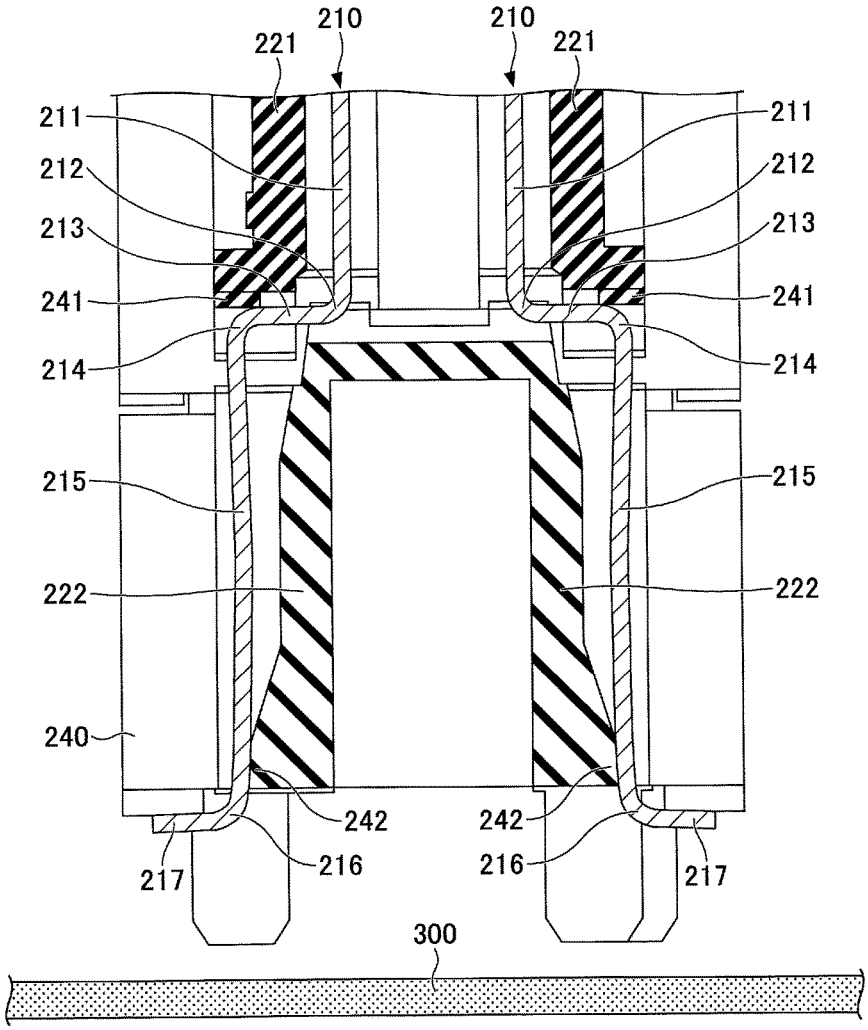
FIG. 3 is a cross-sectional view of a jack connector of the embodiment.

Next, by exemplifying the jack connector 200, the jack contacts 210 provided in the insulating body portion 220 are described. FIG. 3 is a cross-sectional view of the jack connector 200. The plug connector 100 has a similar structure, as will be described in detail later.

The jack contact 210 is formed by bending a metal. As illustrated in FIG. 3, the jack contact 210 includes, in this order from one end to the other end, a first linear portion 211, a first bent portion 212, a second linear portion 213 (an upper linear portion), a second bent portion 214 (a bent portion), a third linear portion 215 (a side linear portion), a third bent portion 216 and a fourth linear portion 217. Here, each of the first linear portion 211, the second linear portion 213, the third linear portion 215 and the fourth linear portion 217 may include a curved portion in addition to a linear portion, and further, may be formed by a gradually curved portion.

At the first bent portion 212, the second linear portion 213 is bent substantially perpendicular with respect to the first linear portion 211. At the second bent portion 214, the third linear portion 215 is bent substantially perpendicular with respect to the second linear portion 213. At the third bent portion 216, the fourth linear portion 217 is bent substantially perpendicular with respect to the third linear portion 215. Thus, the first linear portion 211 and the third linear portion 215 are substantially in parallel, and the second linear portion 213 and the fourth linear portion 217 are substantially in parallel.

The first linear portion 211 is a portion to be connected to the plug contact 110. The fourth linear portion 217 is a portion to be connected to a terminal (not illustrated in the drawings) of a printed board 300 by solder, and is referred to as a lead as well. Here, FIG. 3 illustrates a state where the jack contact 210 is not yet connected to the terminal of the printed board 300.

The upper insulating body 221 includes pressing-down portions 241, each having a convex shape, that presses the respective second bent portion 214 to a lower direction in FIG. 3, in other words, a direction where the fourth linear portion 217 is formed. By pressing the second bent portions 214 down by the pressing-down portions 241, respectively, heights of the fourth linear portions 217 of the jack contacts 210 at a surface facing the printed board 300 can be matched, in other words, positions of the fourth linear portions 217 in an upper and lower direction in FIG. 3 can be matched. Thus, the fourth linear portions 217 can be surely connected to the printed board 300 by solder.

Further, in this embodiment, a locator 240 is provided that covers the jack contacts 210 attached to the lower insulating body 222. The lower insulating body 222 includes ejected portions 242 that are protruded toward the locator 240 at a side near the printed board 300. In this embodiment, as each of the third linear portions 215 of the jack contact 210 is pressed toward the locator 240 by the respective ejected portion 242, positions of the fourth linear portions 217 at the surface facing the printed board 300 can be matched in a lateral direction in FIG. 3. For example, by pressing the third linear portions 215 by the ejected portions 242, respectively, to contact an inner wall surface of the locator 240, the positions of the fourth linear portions 217 can be matched.

(Impedance Matching)

Next, impedance matching of the connector of the embodiment is described by using the jack connector 200 as an example. Here, the following description can also be applied to the plug connector 100.

Figure 4:
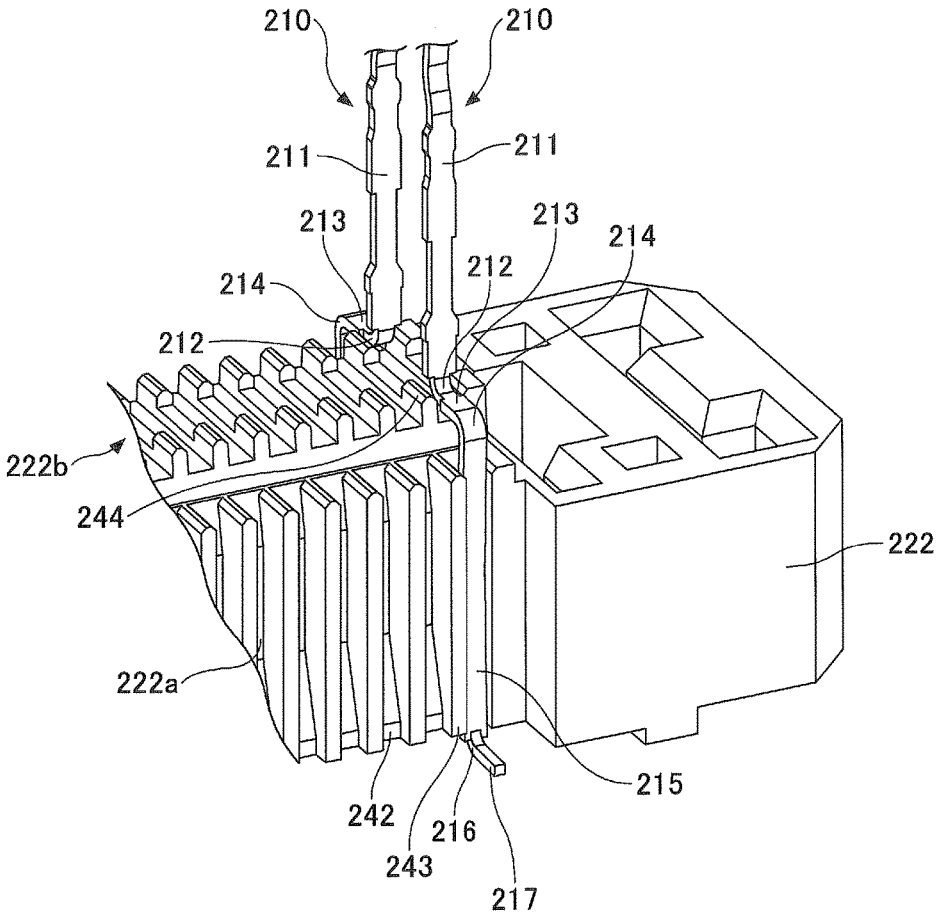
FIG. 4 is a perspective view of an inside of the jack connector of the embodiment.
Figure 5:
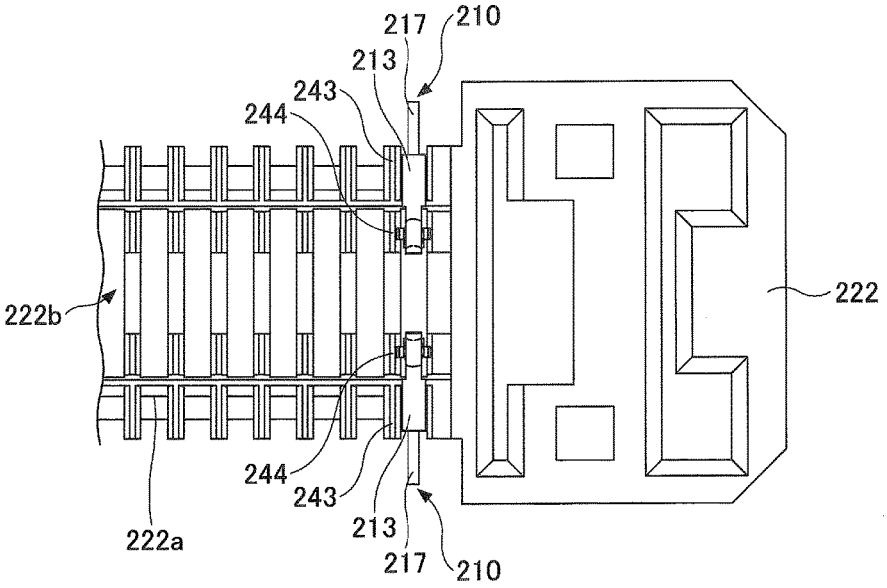
FIG. 5 is a top view of the inside of the jack connector of the embodiment.

In this embodiment, as illustrated in FIG. 4 FIG. and 5, the second linear portion 213, the second bent portion 214 and the third linear portion 215 of the jack contact 210 are provided to position outside of the lower insulating body 222. In each of FIG. 4 and FIG. 5, the locator 240 is not illustrated.

The third linear portions 215 are provided such that inside surfaces thereof face a side surface 222*a* of the lower insulating body 222, in other words, extend along the side surface 222*a*. Specifically, a plurality of first protrusions 243 are provided at the side surface 222*a* of the lower insulating body 222. The first protrusions 243 are provided such that the third linear portion 215 of each of the jack contacts 210 is positioned between the adjacent first protrusions 243. With this configuration, positions of the jack contacts 210 in a longitudinal direction of the jack connector 200 are defined by the first protrusions 243.

Further, the second linear portions 213 are provided such that inner surfaces thereof face an upper surface 222*b* of the lower insulating body 222, in other words, extend along the upper surface 222*b*. Specifically, a plurality of second protrusions 244 are provided at the upper surface 222*b* of the lower insulating body 222. The second protrusions 244 are provided such that the second linear portion 213 of each of the jack contacts 210 is positioned between the adjacent second protrusions 244. With this configuration, positions of the jack contacts 210 in the longitudinal direction of the jack connector 200 are defined by the second protrusions 244 as well. Furthermore, by providing the second protrusions 244 at the upper surface 222*b*, impedance can be adjusted and impedance matching can be performed.

Heights of the second protrusions 244 are formed to be higher than heights of the second linear portions 213 of the jack contacts 210. Here, as the lower insulating body 222 is made of an insulating material, the first protrusions 243 and the second protrusions 244 are also made of the insulating material.

Figure 6:
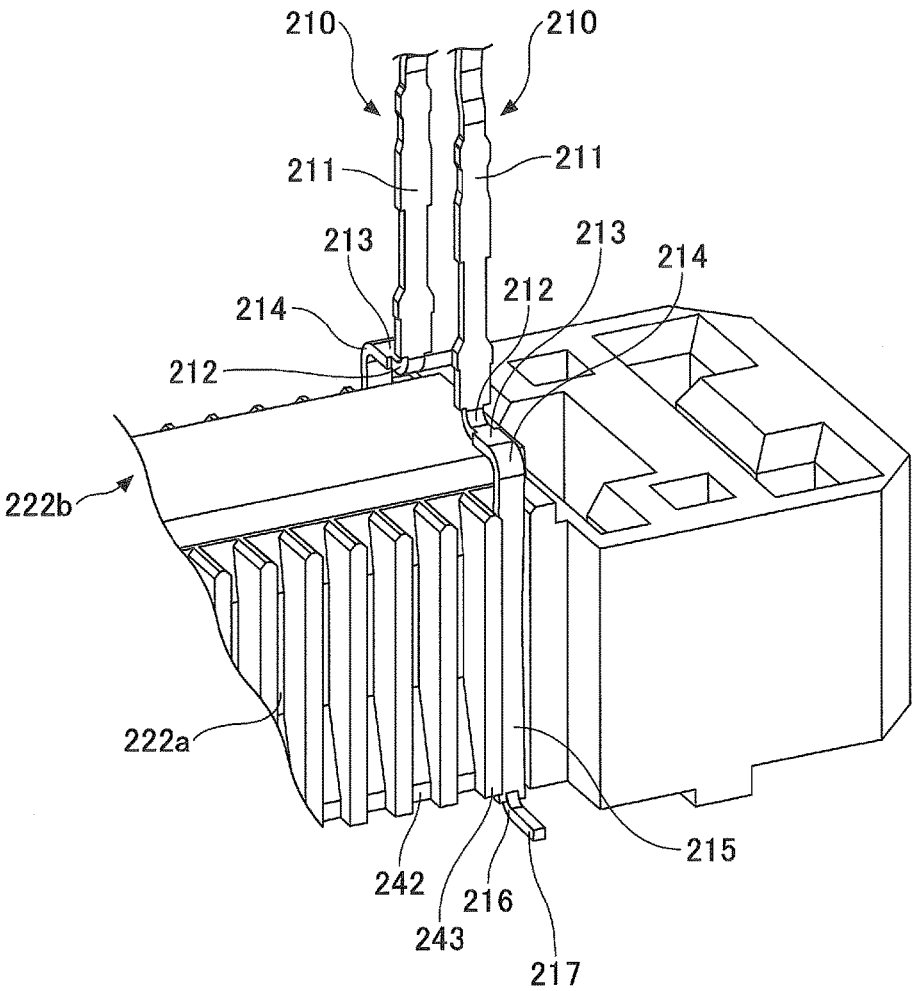
FIG. 6 is a perspective view of an inside of a jack connector of a reference example.

Next, a fact that the impedance matching can be improved by providing the second protrusions 244 is described by referring to a jack connector illustrated in FIG. 6 in which protrusions are only provided at a side surface of a lower insulating body and not provided at an upper surface of the lower insulating body.

Figure 7:
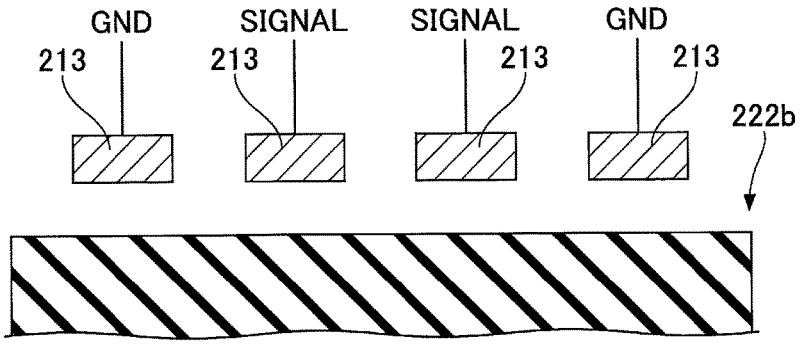
FIG. 7 is a cross-sectional view of a main part of the jack connector of the reference example.

As illustrated in FIG. 6, when protrusions are not formed at the upper surface 222*b* of the lower insulating body, as illustrated in FIG. 7, only a space is provided between the second linear portions 213 of the adjacent jack contacts 210. A value of impedance in this case at a cross-section was 135Ω.

Figure 8:
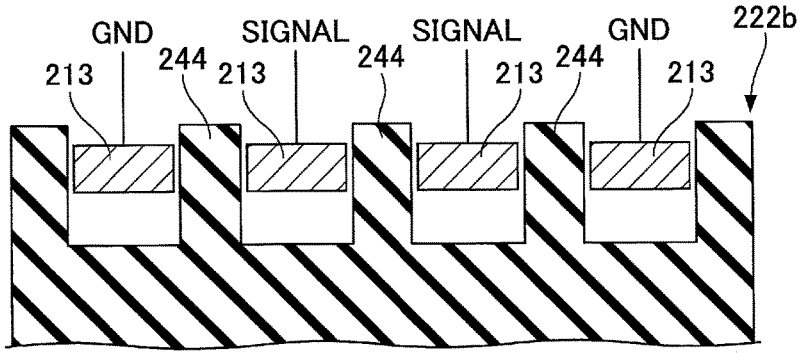
FIG. 8 is a cross-sectional view of a main part of the jack connector of the embodiment.

Meanwhile, in this embodiment, as illustrated in FIG. 4, the second protrusions 244 are formed at the upper surface 222*b* of the lower insulating body 222 in addition to the side surface 222*a* of the lower insulating body 222. In other words, as illustrated in FIG. 8, the second protrusion 244 is positioned between the adjacent second linear portions 213 at the upper surface 222*b*. A value of impedance in this case at a cross-section was 104Ω. Thus, by providing the second protrusions 244 at the upper surface 222*b*, impedance can be adjusted, and impedance matching can be performed.

Furthermore, as described above, the plug connector 100 has a structure similar to the jack connector 200. Specifically, not illustrated in the drawings, each of the plug contacts 110 includes, in this order from one end to the other end, a first linear portion, a first bent portion, a second linear portion (corresponding to an upper linear portion), a second bent portion (corresponding to a bent portion), a third linear portion (corresponding to a side linear portion), a third bent portion and a fourth linear portion.

Furthermore, the upper insulating body 121 of the insulating body portion 120 includes pressing-down portions similarly as the pressing-down portions 241, each having a convex shape, that presses the respective second bent portion of the plug contact 110 to a lower direction in FIG. 1A.

Furthermore, a locator similarly as the locator 240 is provided that covers the plug contacts 110 attached to the lower insulating body 122 of the insulating body portion 120. The lower insulating body 122 includes ejected portions similarly as the ejected portions 242 that are protruded toward the locator.

Furthermore, a plurality of first protrusions similarly as the first protrusions 243 are provided at a side surface of the lower insulating body 122 of the insulating body portion 120.

Furthermore, a plurality of second protrusions similarly as the second protrusions 244 are provided at an upper surface of the lower insulating body 122 of the insulating body portion 120.

Thus, similarly as the jack connector 200, impedance can be adjusted, and impedance matching can be performed in the plug connector 100 as well.

According to the connector of the disclosure, impedance matching of the connector can be easily adjusted, and an electric signal can be transmitted at high speed.

Although a preferred embodiment of the connector has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

What is claimed is:

1. A connector comprising:

a plurality of contacts, each including a first linear portion, a second linear portion, a third linear portion, a first bent portion provided between the first linear portion and the second linear portion, and a second bent portion provided between the second linear portion and the third linear portion, the second linear portion being perpendicular to both the first linear portion and the third linear portion, the first linear portion and the third linear portion extending in the same direction;

an upper insulating body; and a lower insulating body, the contacts being provided such that a side surface of the lower insulating body faces an inside surface of the third linear portion of each of the contacts, and an upper surface of the lower insulating body faces an inside surface of the second linear portion of each of the contacts, upper protrusions being provided at the upper surface of the lower insulating body such that each of the upper protrusions positions between the second linear portions of the adjacent contacts, wherein the first linear portion of each of the contacts is disposed inside the upper insulating body.

2. The connector according to claim 1, wherein the second linear portion of each of the contacts is positioned between the lower insulating body and the upper insulating body.

3. The connector according to claim 1, wherein second protrusions are provided at the side surface of the lower insulating body such that each of the second protrusions positions between the third linear portions of the adjacent contacts.

4. The connector according to claim 1, wherein the contacts are provided such that the second linear portion of each of the contacts extend along the upper surface of the lower insulating body, the third linear portion of each of the contacts extends along the side surface of the lower insulating body, and the second bent portion of each of the contacts is bent at a corner of the lower insulating body between the upper surface and the side surface.

* * * * *